US006382761B1

(12) United States Patent
Asano et al.

(10) Patent No.: US 6,382,761 B1
(45) Date of Patent: May 7, 2002

(54) RECORDING APPARATUS AND BATTERY HOLDING MECHANISM FOR USE IN THE RECORDING APPARATUS

(75) Inventors: Shinya Asano, Tokyo; Koh Hasegawa; Hiroyuki Inoue, both of Yokohama; Takashi Nojima, Tokyo; Akira Kida, Kawasaki; Takeshi Iwasaki, Yokohama; Noriko Kawasaki, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/288,701

(22) Filed: Apr. 9, 1999

(30) Foreign Application Priority Data

Apr. 15, 1998 (JP) ..... 10-105169

(51) Int. Cl.[7] ..... B41J 29/393; B41J 3/36; B41J 3/39

(52) U.S. Cl. ..... 347/19; 400/88

(58) Field of Search ..... 347/19, 108, 109, 347/50; 400/88, 691, 692, 693; 429/96–97, 100, 164

(56) References Cited

U.S. PATENT DOCUMENTS

| | | | | |
|---|---|---|---|---|
| 4,345,262 A | * | 8/1982 | Shirato et al. | 347/10 |
| 4,725,157 A | | 2/1988 | Nakai et al. | 400/680 |
| 4,759,646 A | | 7/1988 | Piatt | 400/88 |
| 5,163,766 A | | 11/1992 | Fushimi et al. | 400/692 |
| 5,216,371 A | | 6/1993 | Nagai | 324/428 |
| 5,220,520 A | * | 6/1993 | Kessoku | 364/708 |
| 5,475,626 A | * | 12/1995 | Viletto | 364/708.1 |
| 5,736,271 A | | 4/1998 | Cisar et al. | 429/96 |

FOREIGN PATENT DOCUMENTS

| | | | |
|---|---|---|---|
| EP | 0 364 119 | 4/1990 | G06F/1/16 |
| EP | 0 540 301 | 5/1993 | B41J/11/56 |
| GB | 2287907 | 10/1995 | B41J/3/36 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A recording apparatus has a battery as a driving power source of the recording apparatus, a holding portion for holding the battery, and a connecting device for electrically connecting the recording apparatus and the battery to each other when the battery is held in the holding portion. A biasing device biases the battery on a side opposed to a mounting direction of the battery when the battery is held in the holding portion, and a fixing device fixes the battery held in the holding portion against the biasing force of the biasing device.

33 Claims, 14 Drawing Sheets

RECORDING APPARATUS AND BATTERY HOLDING MECHANISM FOR USE IN THE RECORDING APPARATUS

BACKGROUND OF THE INVENTION

1. Field of the Invention

The present invention relates to a recording apparatus and particularly relates to a battery holding mechanism of the recording apparatus drivable by a battery.

2. Related Background Art

A recording apparatus having functions of a printer, a copying machine, a facsimile, etc. or a recording apparatus used as a composite type electronic device including a computer, a word processor, etc. and an output device of a work station is constructed such that an image is recorded to a recorded material (recording medium) such as a sheet of paper, a plastic thin plate, etc. on the basis of image information. These recording apparatuses can be classified into an ink jet type, a wire dot type, a thermal type, a laser beam type, etc. in accordance with recording systems.

As the word processor and a personal computer are made compact, the recording apparatuses of the printer, the copying machine, the facsimile, etc. as output devices of the word processor and the personal computer have been also made compact. In particular, no recording apparatus is normally attached to a portable personal computer called a notebook-sized personal computer, etc., and it is necessary to arrange a portable recording apparatus to record information at locations out of home or office.

In the portable recording apparatus, it is necessary to make the recording apparatus compact and light in weight and operate the recording apparatus by a battery.

As a battery structure, a battery body normally called a cell is conventionally received in a battery case having a shape in which the battery body is detachably attached to a connecting terminal and the recording apparatus on an outer side of this battery body. When the capacity of a voltage is insufficient in the case of one cell, cells may be electrically connected in series or parallel to each other within the battery case. This battery case is detachably accomodated in a storing portion arranged on a lower and rear sides of the recording apparatus, and this storing portion is covered with a cover which is freely openable and closable.

However, in the above conventional recording apparatus, it is necessary to perform an operation in which the recording apparatus is turned upside down and the cover is detached from the recording apparatus, etc. so as to attach and detach the battery for operating the recording apparatus. Accordingly, it takes much time and labor to exchange batteries at a carrying locations.

SUMMARY OF THE INVENTION

An object of the present invention is to provide a recording apparatus having a battery attaching-detaching means in which a battery for operating the recording apparatus can be simply detachably attached to the recording apparatus by one touch operation.

Another object of the present invention is to provide a recording apparatus comprising a battery as a driving power source of the recording apparatus; a holding portion for holding the battery; connecting means for electrically connecting said recording apparatus and said battery to each other when said battery is held in the holding portion; biasing means for biasing said battery on a side opposed to a mounting direction of the battery when said battery is held in said holding portion; and fixing means for fixing said battery held in said holding portion against the biasing force of the biasing means.

Another object of the present invention is to provide a battery holding mechanism comprising:

a battery as a driving power source of a device;

a holding portion for holding the battery;

connecting means for electrically connecting said device and said battery to each other when said battery is held in the holding portion;

biasing means for biasing said battery on a side opposed to a mounting direction of the battery when said battery is held in said holding portion; and fixing means for fixing said battery held in said holding portion against the biasing force of the biasing means.

DETAILED DESCRIPTION OF THE PREFERRED EMBODIMENTS

The embodiments of the present invention will next be explained concretely with reference to the drawings.

[Construction of Entire External Appearance]

Figure 1:
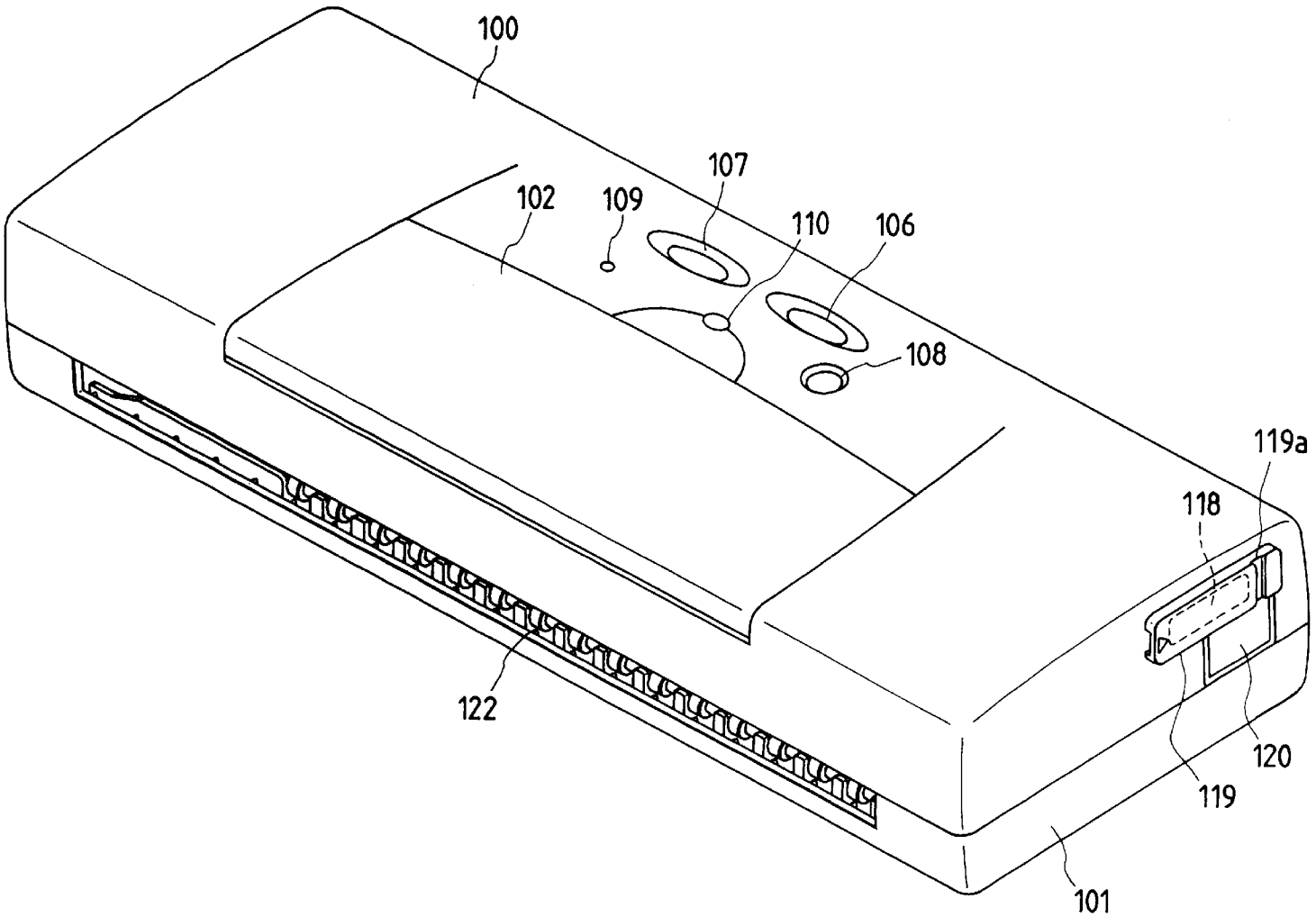
FIG. 1 is a perspective view of an external appearance of a recording apparatus in one embodiment of the present invention seen from a paper discharging port side.
Figure 2:
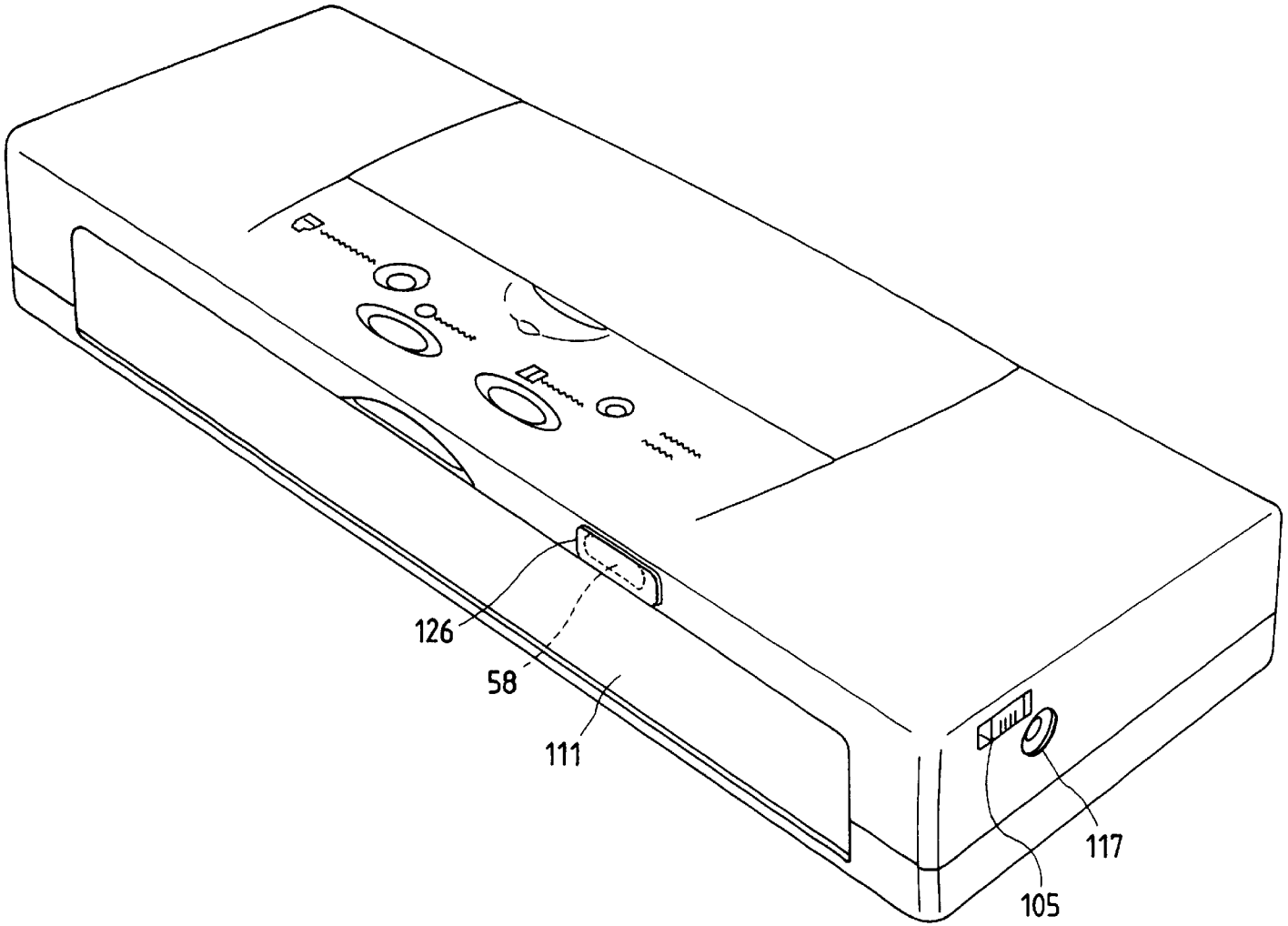
FIG. 2 is a perspective view of the recording apparatus shown in FIG. 1 and seen from a side opposed to the paper discharging port side.
Figure 3:
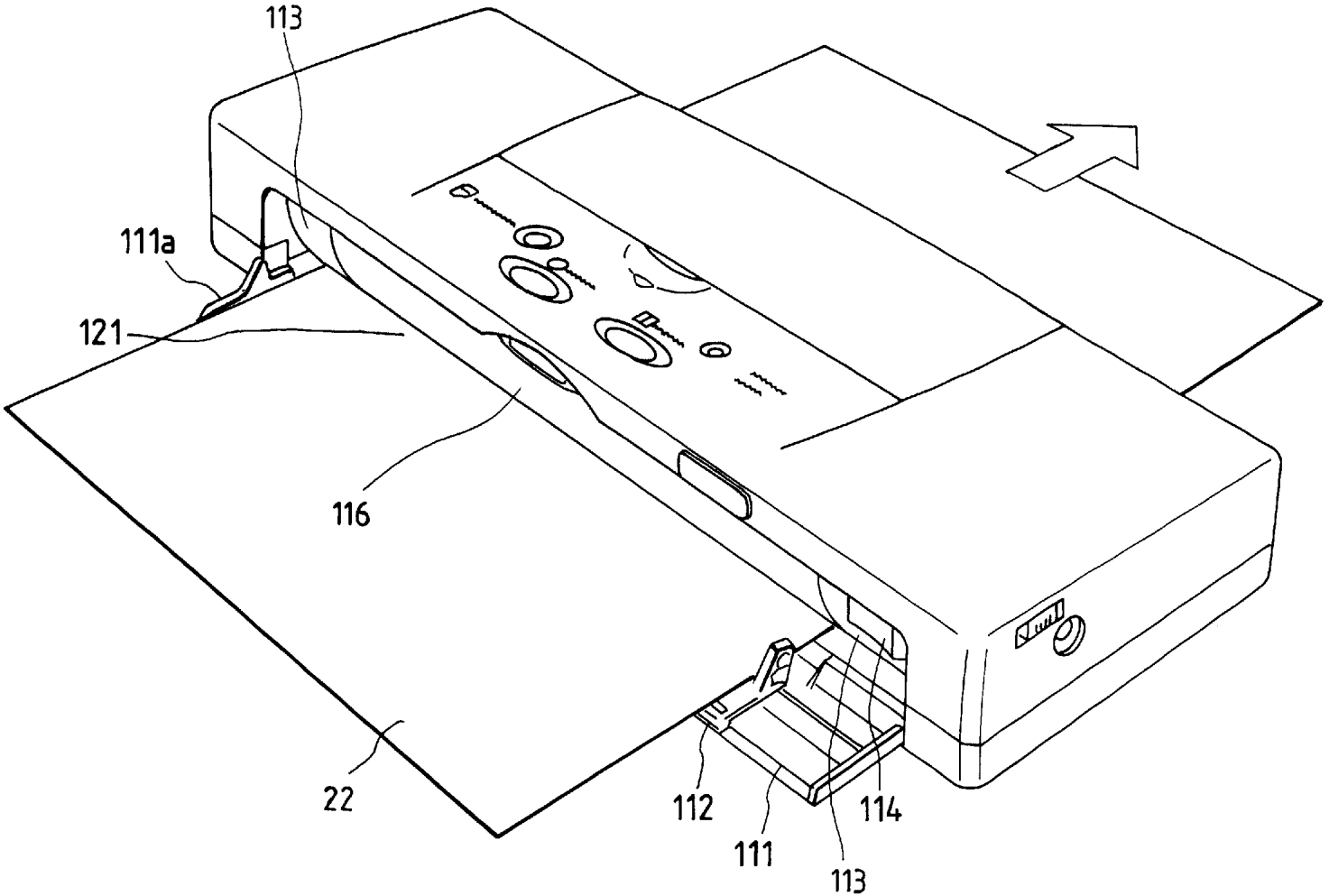
FIG. 3 is a perspective view showing a using state of the recording apparatus shown in FIGS. 1 and 2.

FIG. 1 is a perspective view of an external appearance of a recording apparatus in one embodiment of the present invention seen from a paper discharging port side. FIG. 2 is a perspective view of the recording apparatus shown in FIG. 1 and seen from a side opposed to the paper discharging port side. FIG. 3 is a perspective view showing a using state of the recording apparatus shown in FIGS. 1 and 2.

The recording apparatus in the embodiment shown in FIGS. 1 and 2 is constructed by an upper case 100 covering an upper face of the recording apparatus and a lower case 101 covering a lower face of the recording apparatus, and is divided into the upper and lower cases by a sheet passage.

Figure 4:
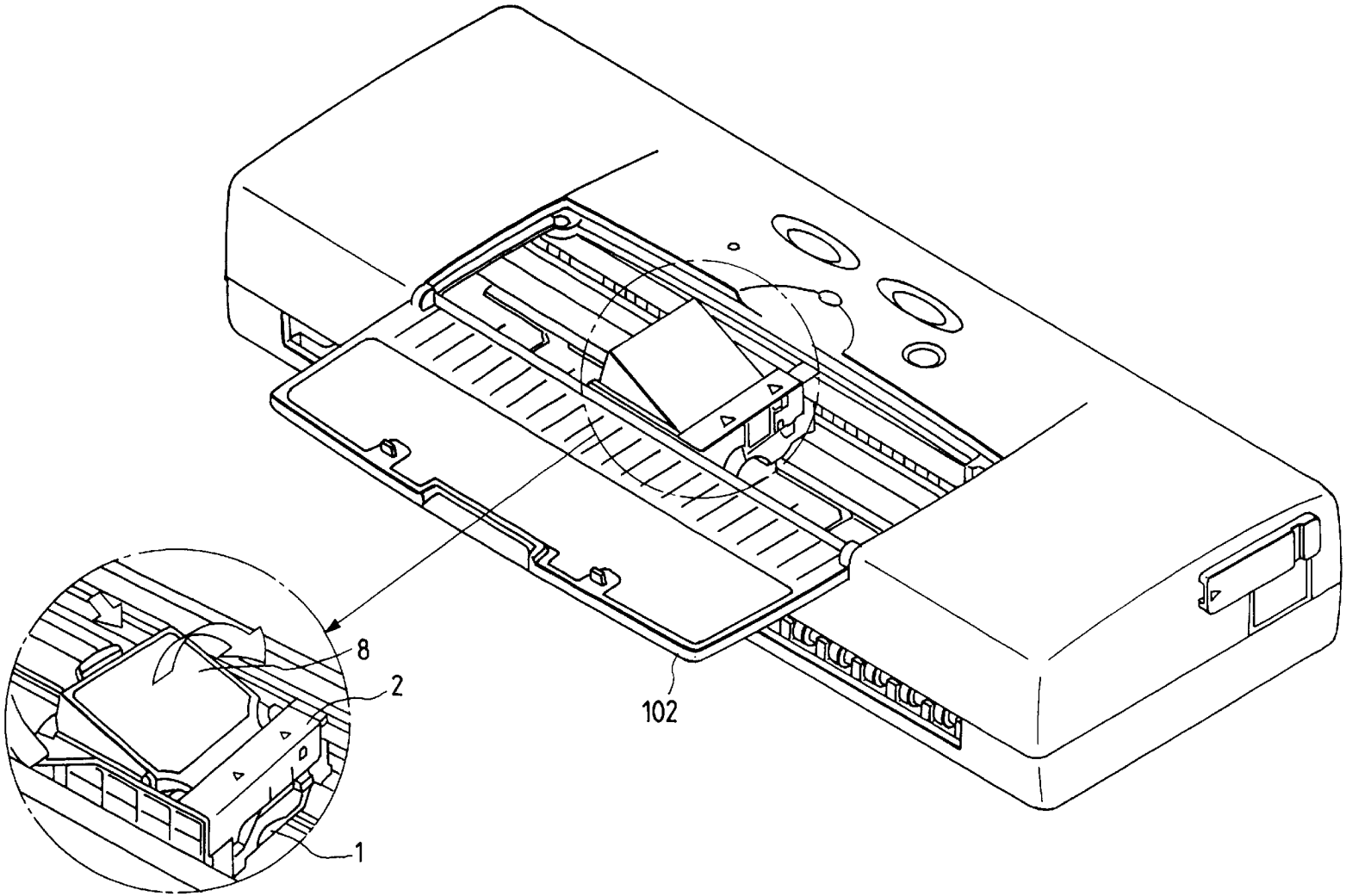
FIG. 4 is a view showing an opening state of a head exchanging cover shown in FIGS. 1 and 2.

A hole portion is formed in the upper case 100 shown in FIGS. 1 and 2, and a head exchanging cover 102 is arranged in the upper case 100 so as to cover this hole portion. FIG. 4 shows an opening state of this head exchanging cover 102. As shown in this FIG. 4, a recording head cartridge 1 can be exchanged through the hole portion of the upper case 100 by opening the head exchanging cover 102. Further, it is possible to perform jam processing and clean the interior of the recording apparatus through the hole portion when a paper jam is caused within the recording apparatus (printer).

The hole portion covered by the head exchanging cover 102 is formed in an approximately central portion of the upper case 100 to which only on e portion of a carrier scanning range described later is exposed. Since the hole portion is opened in only one portion of the upper case 100, a reduction in rigidity of the upper case 100 is restrained to a minimum limit.

Further, since a n upper portion of a recovering portion described later is covered with the upper case 100 at any time, it is possible to prevent dust, etc. from being deposit ed to the recovering portion. When the carrier 2 is moved to a position of the recovering portion to recover a head, there is also an effect in which no user carelessly comes in contact with the head.

As shown in FIGS. 1, 2 and 3, a power switch 106 for turning on and off a power source of the recording apparatus, a power lamp 110 showing a turning-on state of the power source, an error lamp 109 showing an error state of the recording apparatus, and an error releasing switch 107 for releasing the error state of the recording apparatus are arranged on an upper face of the recording apparatus. The error lamp 109 is turned on when various kinds of obstacle states of the recording apparatus are caused. The error releasing switch 107 releases the error by pushing this switch when the obstacle states of the recording apparatus are released.

Further, a hold switch 105 for invalidating the power switch 106 and a power connector 117 for supplying power to the recording apparatus are arranged on one side of the recording apparatus so as not to carelessly turn on the power source when the recording apparatus (printer) is carried.

An interface connector 118 for connecting a signal cable from a host computer and an infrared communication window 120 for infrared communication are arranged on another side of the above recording apparatus. The interface connector 118 is covered with an interface connector cover 119. The interface connector cover 119 is molded by an elastic body. One end of the interface connector cover 119 is fixed to the upper case 100 and the other end of the interface connector cover 119 is set to a free end. A hinge portion 119*a* of the cover 119 is thinly molded in comparison with the other portions so that this hinge portion 119*a* has a hinge function. The hinge portion 119*a* is selectively formed by a material of adibate system hardness 85 (shore A) of thermoplastic polyurethane having a preferable tear resisting property.

In this recording apparatus, a sheet is inserted from a paper feed port 121 and is discharged from a paper discharging port 122 (see FIG. 1) as shown in FIG. 3.

When no recording apparatus is used, a paper feed tray 111 is in a closing state as shown in FIG. 2. When the recording apparatus is used, the paper feed tray 111 guides a fed sheet 22 of recording paper in an opening state as shown in FIG. 3.

A left-hand guide portion 111*a* as an inserting reference of the sheet is integrally arranged in the paper feed tray 111. A left-hand reference position with respect to a paper feed direction is the same irrespective of a paper size. In contrast to this, a right-hand guide 112 for guiding a right-hand end portion of the recording sheet 22 is used by sliding this right-hand guide 112 by a user in conformity with the sheet size.

Figure 5:
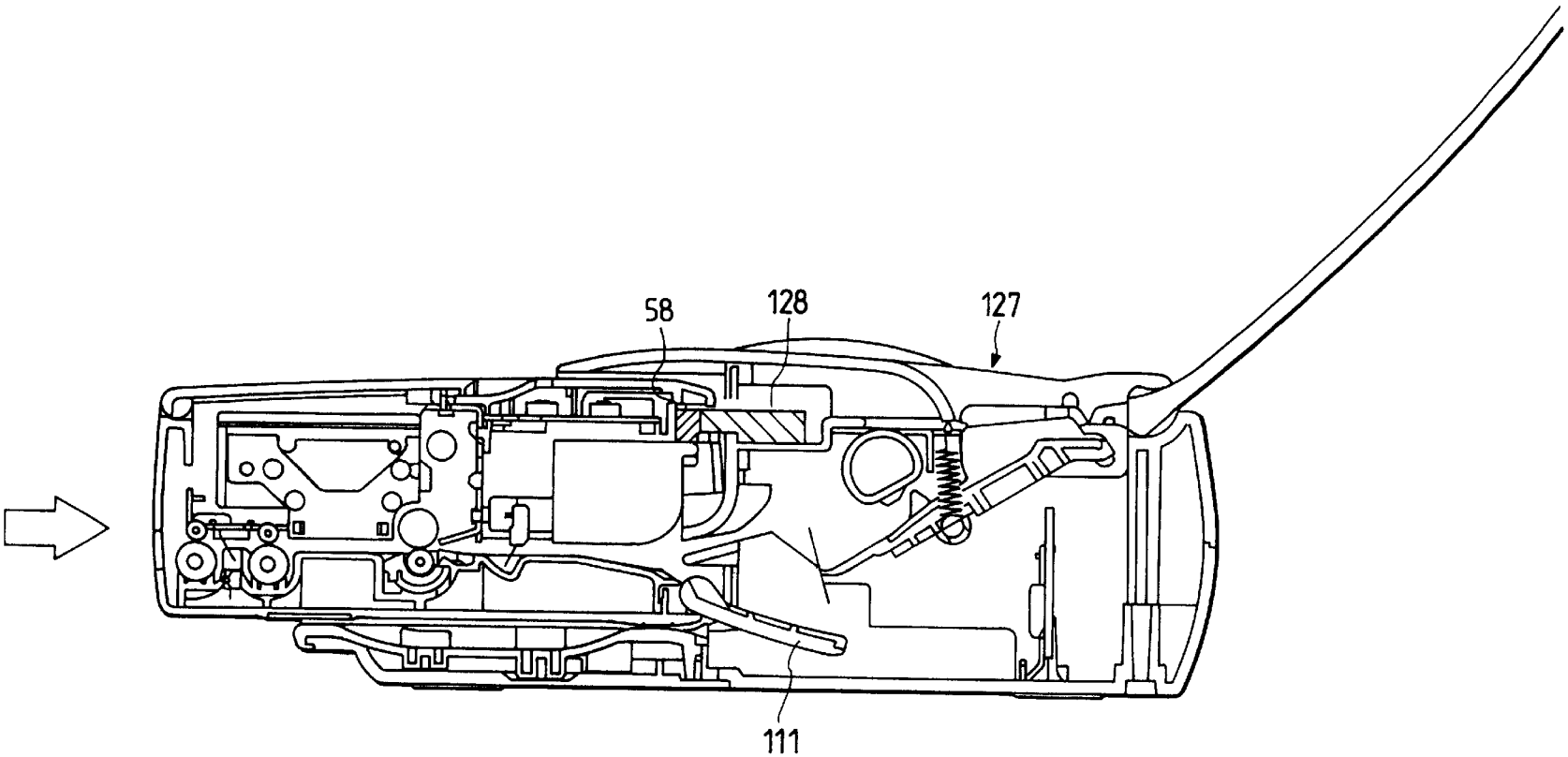
FIG. 5 is a cross-sectional view showing a state in which an automatic sheet feeder (ASF) is mounted to the recording apparatus in one embodiment of the present invention.

An option connector 58 is arranged on a face of the paper feed port 121. The option connector 58 is covered with an option connector cover 126 when no recording apparatus is used (see FIG. 2). There is an automatic sheet feeder (ASP) shown in FIG. 5 as one option example of this recording apparatus. The ASF 127 has an ASF connector 128 connected to the option connector 58. This recording apparatus and the ASF 127 are slid in an arrow direction of FIG. 5 and are combined with each other. At this time, since a paper passing direction is equal to a combining direction of the recording apparatus and the ASF 127, a space of the paper discharge is normally secured in a paper discharging direction in an arranging place of the ASF 127 so that the ASF 127 can be easily mounted to the recording apparatus. For example, in a system for connecting the ASF 127 to the recording apparatus from a direction perpendicular to the paper passing direction, a space is also required on a side of the ASF 127 so that the arranging place of the ASF 127 is limited. Further, since the paper passing direction is equal to a releasing direction of the combination, processing is easily performed when the sheet is jammed.

Since the option connector 58 is arranged on the same face as the paper feed port 121 at the combining time, the recording apparatus is simultaneously connected to the ASF connector 128 without consciousness of the user. Accordingly, it is possible to prevent troubles of labor and forgetting of the connection, insufficiency of the connector insertion, etc.

A battery is also built in this recording apparatus mainly in consideration of a case in which the recording apparatus is carried and used.

The length of a hand palm approximately ranges from 70 mm to 120 mm. Accordingly, in consideration of easiness of gripping, it is suitable for portability when the recording apparatus has a thickness equal to or smaller than 60 mm. Therefore, the recording apparatus has about 300 mm in width, about 110 mm in depth and about 50 mm in thickness so that the recording apparatus has a size capable of manually gripping this recording apparatus and portability is improved.

Further, a total weight of the recording apparatus is set to about 900 g (grams) by lightening techniques of a pinch roller made of aluminum, a hollow paper feed roller, a hollow guide shaft, a lithium ion battery having preferable volume efficiency, etc. to improve portability.

[Entire Internal Construction]

Figure 6:
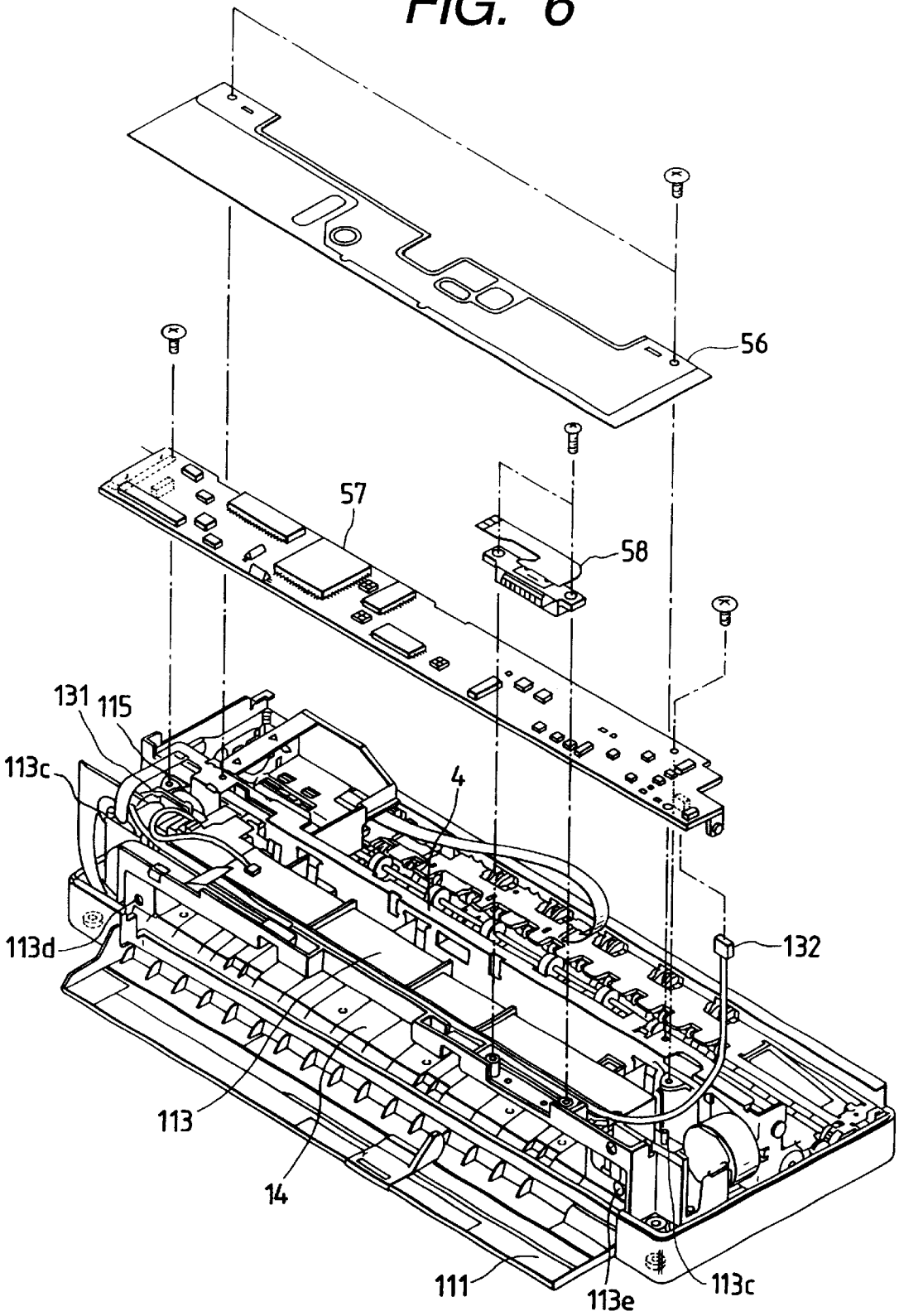
FIG. 6 is an exploded perspective view showing an internal construction of the recording apparatus in one embodiment of the present invention.
Figure 7:
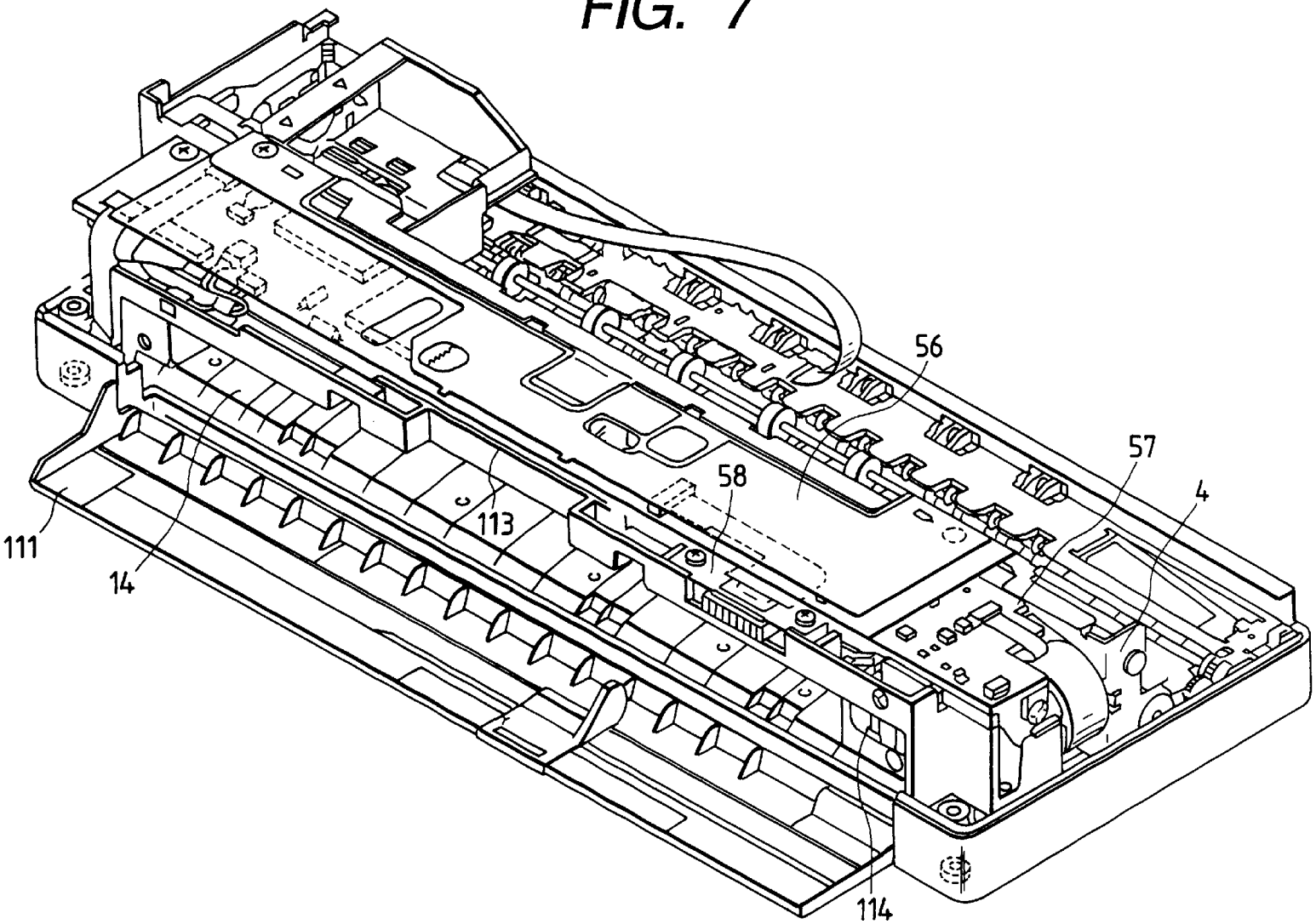
FIG. 7 is an exploded perspective view showing the internal construction of the recording apparatus in one embodiment of the present invention.

FIGS. 6 and 7 are exploded perspective views showing an internal construction of the recording apparatus in one embodiment of the present invention.

In FIGS. 6 and 7, a platen 14 constitutes a recovering system section, a lower portion of a paper feed section, etc.

A frame 4 is constructed by a material of aluminum to make the frame light in weight and holds a carrier scanning section, an upper portion of the paper feed section, etc. and constitutes the recording apparatus.

A boss of the platen 14 formed on the paper discharging side on each of left-hand and right-hand sides and a notch portion of the frame 4 are fitted to each other so that the platen 14 and the frame 4 are positioned. The frame 4 is engaged with a claw portion formed on the paper feed side on each of the left-hand and right-hand sides of the platen 14 so that the frame 4 is fixed.

A holder 113 shown in FIGS. 6 and 7 is positioned by unillustrated two bosses on the paper feed side of the frame 4. The holder 113 is fixed by three claws formed in an upper portion of the frame and one vis in a lower central portion of the frame.

This holder 113 has a function for holding the battery such that the battery is detachably attached to the holder 113. The holder 113 also has a holding function of a substrate 57, a function for guiding an upper path at a feeding time of the recording sheet 22, etc.

Figure 8:
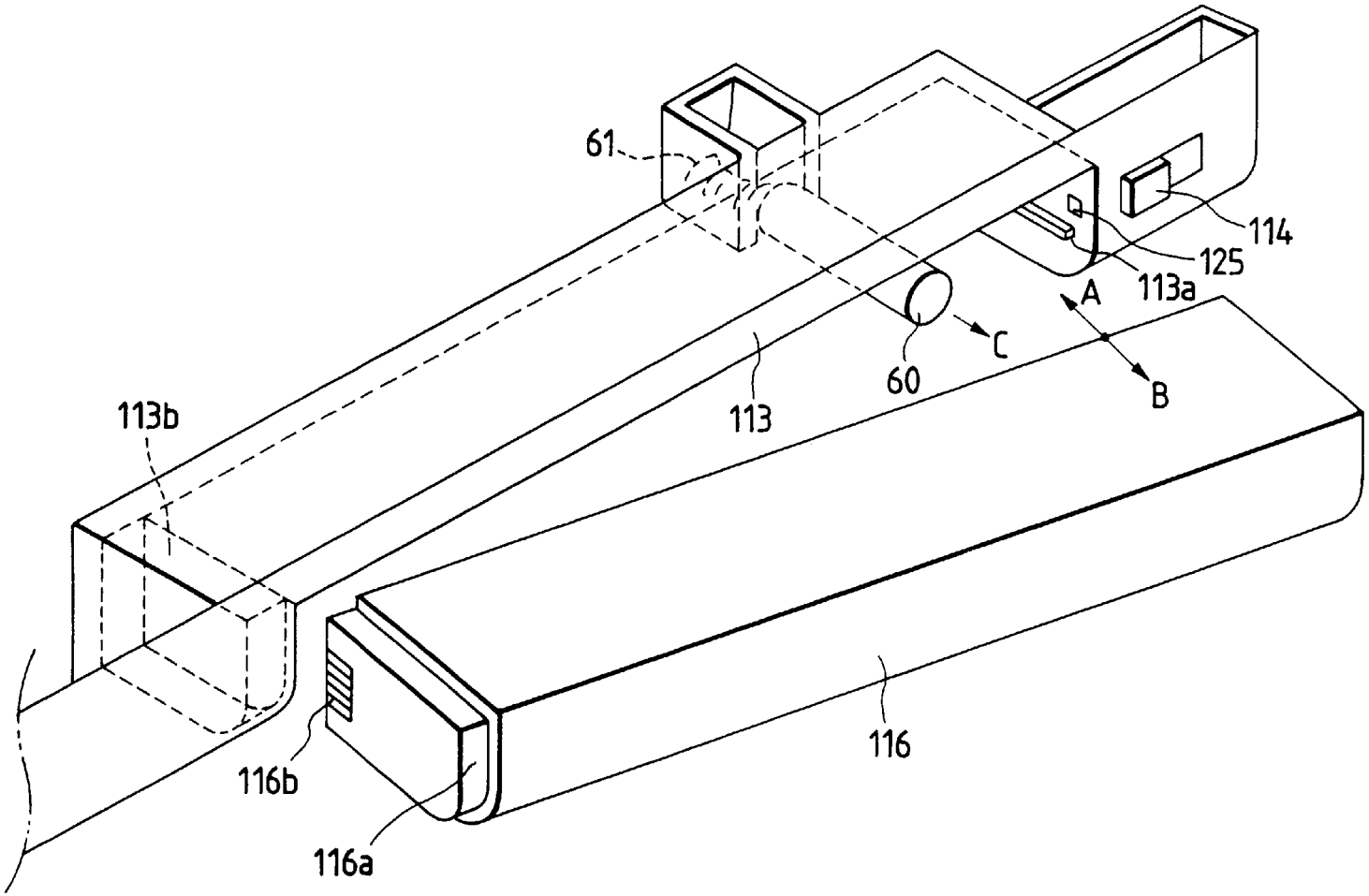
FIG. 8 is a perspective view in which the holding structure of a battery of a substrate holder shown in FIGS. 6 and 7 is enlargedly seen.
Figure 9A:
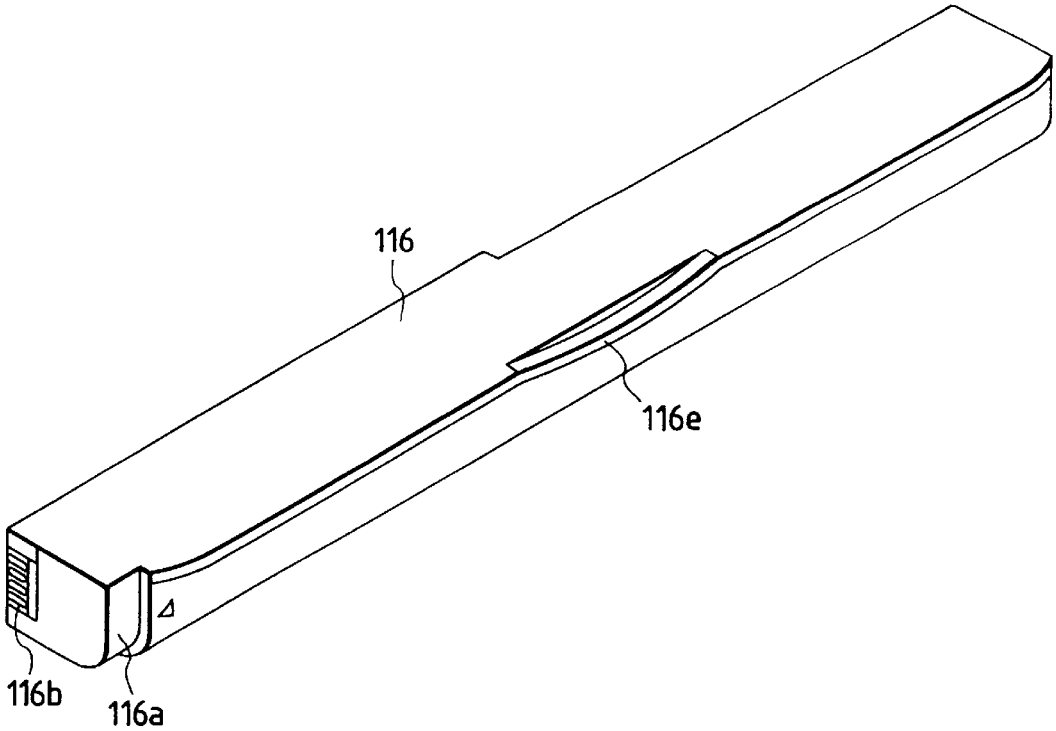
FIGS. 9A and 9B are perspective views showing the construction of the battery shown in FIG. 8.
Figure 9B:
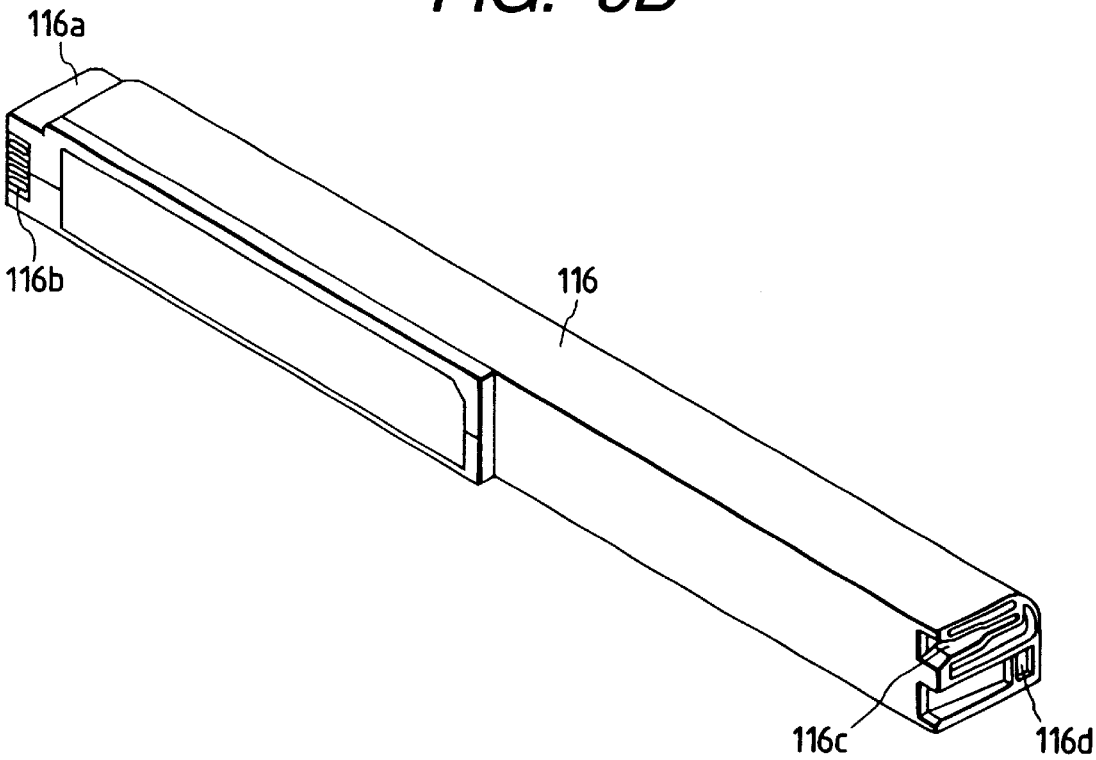

First, the battery holding function of the holder 113 will be explained by using FIGS. 8, 9A and 9B. FIG. 8 is a perspective view of a battery holding structure of the holder 113 enlargedly seen. FIGS. 9A and 9B are perspective views showing the construction of the battery.

A battery contact 115 having four male terminals is held by an unillustrated battery substrate in a soldering state on the outer side of a wall of the holder (holding portion) 113 on the left-hand side seen from the paper feed side of the recording sheet 22. The male terminals of the battery contact 115 are projected into a holder concave portion 113*b* in which one end portion of the battery 116 is stored. A battery cable 131 is connected from an unillustrated battery substrate to the substrate 57 through a battery connector 132.

A holder rail 113*a* and a battery hook 125 are arranged on a face (right-hand side) of the holder 113 opposed to the substrate holder concave portion 113*b*. The holder rail 113*a* is approximately parallel to a conveying direction of a recording medium. The battery hook 125 is slid and is freely projected and recessed. The battery hook 125 is projected and recessed in association with a sliding operation of a battery lock lever 114. The battery hook 125 is biased by an unillustrated battery hook spring in a projecting state at any time.

As shown in FIG. 9B, a battery step difference portion 116*a* is formed in an end portion of the battery 116 in accordance with the holder concave portion 113*b* of the holder 113. A battery contact female 116*b* is formed in a position connected to the battery contact 115. A battery groove portion 116*c* is formed in an end portion of the battery opposed to the battery contact female 116*b* in accordance with the holder rail 113*a*. A battery concave portion 116*d* is further formed in accordance with the battery hook 125.

In such a construction, the battery step difference portion 116*a* of the battery 116 is inserted into the holder concave portion 113*b* of the holder 113. The battery contact 115 and the battery contact female 116*b* are joined to each other. While the holder rail 113*a* in an opposite end portion of the substrate holder 113 is inserted into the battery groove portion 116*c*, the battery 116 is rotated in the direction of an arrow A in FIG. 8 until the battery inserting portion 116*c* hits against the holder rail 113*a*. Thus, the battery hook 125 is fitted into the battery concave portion 116*d* by resilient force of the unillustrated battery hook spring so that the battery 116 is fixed.

A battery pop-up 60 as a biasing means is arranged on a deep side of the holder 113 storing the battery 116 in a portion near an attaching portion of the battery hook 125. This battery pop-up 60 is biased by a battery pop-up spring 61 in a pushing-out direction of the battery 116. Accordingly, when the battery lock lever 114 is slid against the resilient force of the unillustrated battery hook spring, the battery hook 125 is moved in association with the slide of the battery lock lever 114 and is detached from the battery concave portion 116*d*. Accordingly, the battery pop-up 60 is projected out by resilient force of the battery pop-up spring 61 in the direction of an arrow C in FIG. 8, and the battery 116 is pushed out by this resilient force. The battery 116 is then rotated in the direction of an arrow B in FIG. 8 with a contact portion of the battery contact 115 and the battery contact female 116*b* as a center. Thus, the battery 116 is detached from a recording apparatus body.

The battery 116 will next be explained briefly by using FIG. 9A. In the battery 116, unillustrated battery cells are arranged in series and are covered by melting attachment. Further, a battery rib 116*e* is formed along a front width in an upper portion of a front portion of the battery 116 and has a function for preventing the entry of dust when the paper feed tray 111 is closed. A central portion of this battery rib 116*e* is slightly lowered in an arc shape in a downward direction so as to avoid the engagement of a finger with this central portion when the paper feed tray 111 is opened.

Attachment and detachment of the battery with respect to the recording apparatus body based on the above construction will next be explained.

When the battery is mounted to the holding portion, a user first inserts the step difference portion of the battery in its one end portion into the concave portion of the holding portion. Connecting terminals of the concave portion and the step difference portion are then connected to each other, and the battery is rotated against the biasing force of a biasing means toward a portion opposed to the concave portion of the holding portion with a connecting portion of the concave portion and the step difference portion as a center. As the battery is rotated, the groove portion of an end portion of the battery on a side opposed to the step difference portion is engaged with the rail in a portion opposed to the concave portion of the holding portion. Thus, when the battery reaches a predetermined position, the hook is fitted to the concave portion of the battery so that battery is fixed.

In contrast to this, when the battery is detached from the holding portion, the user retreats the hook by a lever so that the hook and the concave portion of the battery are detached from each other. Thus, the battery is pushed out by the biasing force of the biasing means. Then, the battery is rotated with the connecting portion of the step difference portion of the battery and the concave portion of the holding portion as a center and is detached from the holding portion.

A guiding function of an upper path at a feeding time of the recording sheet 22 will next be explained.

Figure 12:
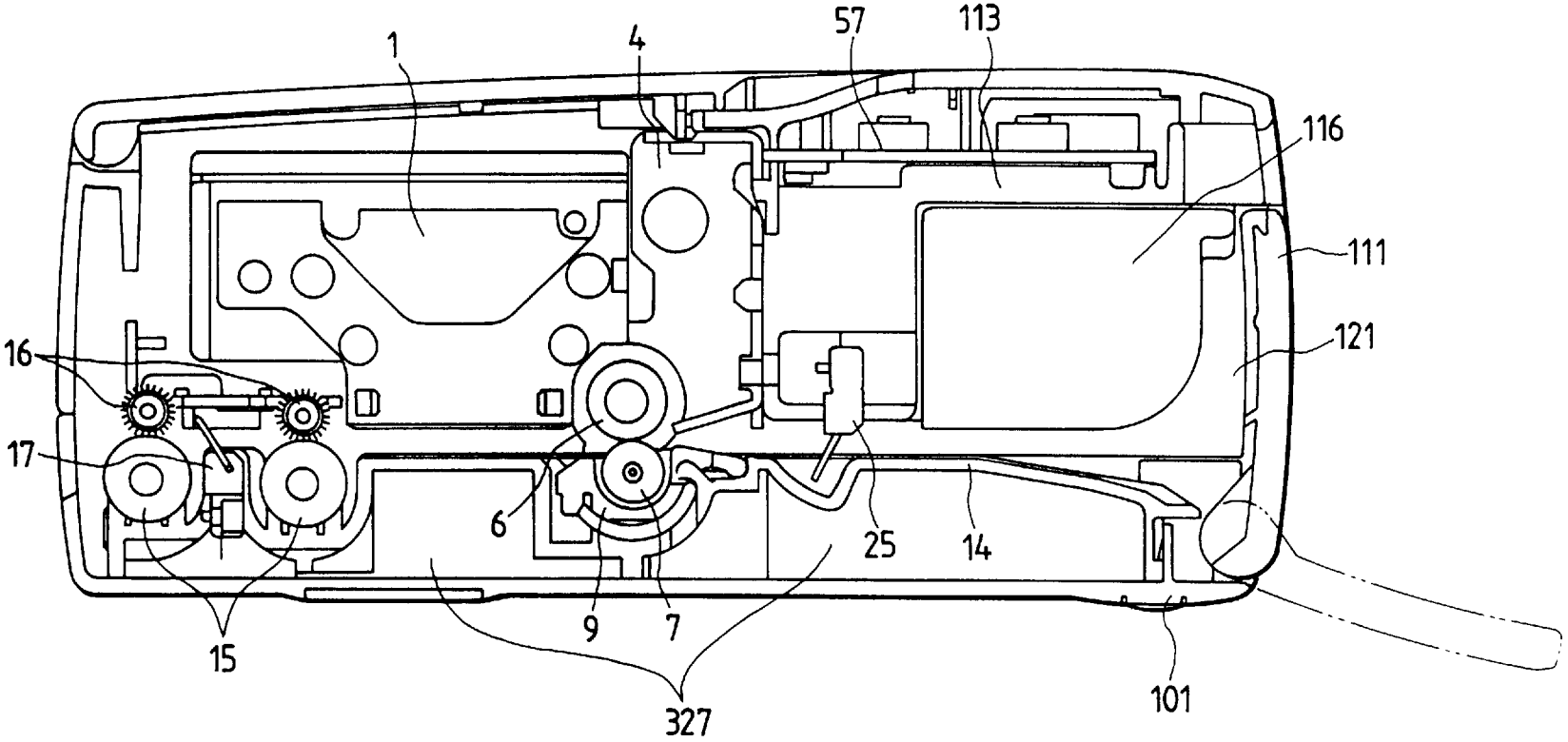
FIG. 12 is a cross-sectional view of the recording apparatus in one embodiment of the present invention.

As shown in FIG. 12, front lower portions of the holder 113 and the battery 116 are formed in a round shape (R-shape) seen on a paper feed side of the recording sheet 22 to easily feed the recording sheet. Further, a paper feed path of the recording sheet 22 is formed by the platen 14 in a lower portion of the recording apparatus and the holder 113 and the battery 116 in an upper portion of the recording apparatus. Accordingly, the holder 113 and the battery 116 also guide the paper feed path.

Further, as shown in FIG. 6, the holder 113 has a holder boss 113*c* formed in each of left-hand and right-hand upper portions on this side on the paper feed side. This holder boss 113*c* is inserted into a hole portion of the substrate 57 and positions and supports the substrate 57. A deep side of the substrate 57 is fixed to the frame 4 by two vises on the left-hand and right-hand sides. The substrate 57 is grounded from these fixing portions. Further, an option connector 58 is fixed to the holder 113 by two vises and is held by this holder 113.

Further, as shown in FIG. 12, a paper sensor 25 is held in a lower portion of the holder 113, i.e., on a paper passing side of the recording sheet 22.

An unillustrated secondary coin battery for holding a memory is held and stored in a portion surrounded by the holder 113.

In FIG. 6, a holder hole portion 113*d* on the left-hand side and a holder elongated hole portion 113*e* on the right-hand side are formed in a front portion of the holder 113 on its paper feed side and constitute a positioning portion of the ASF 127.

The construction showing an arrangement of the upper case 100, the power switch 106, the error releasing switch 107, the shield plate 56 and the substrate 57 will next be explained with reference to the cross-sectional view of FIG. 10.

Figure 10:
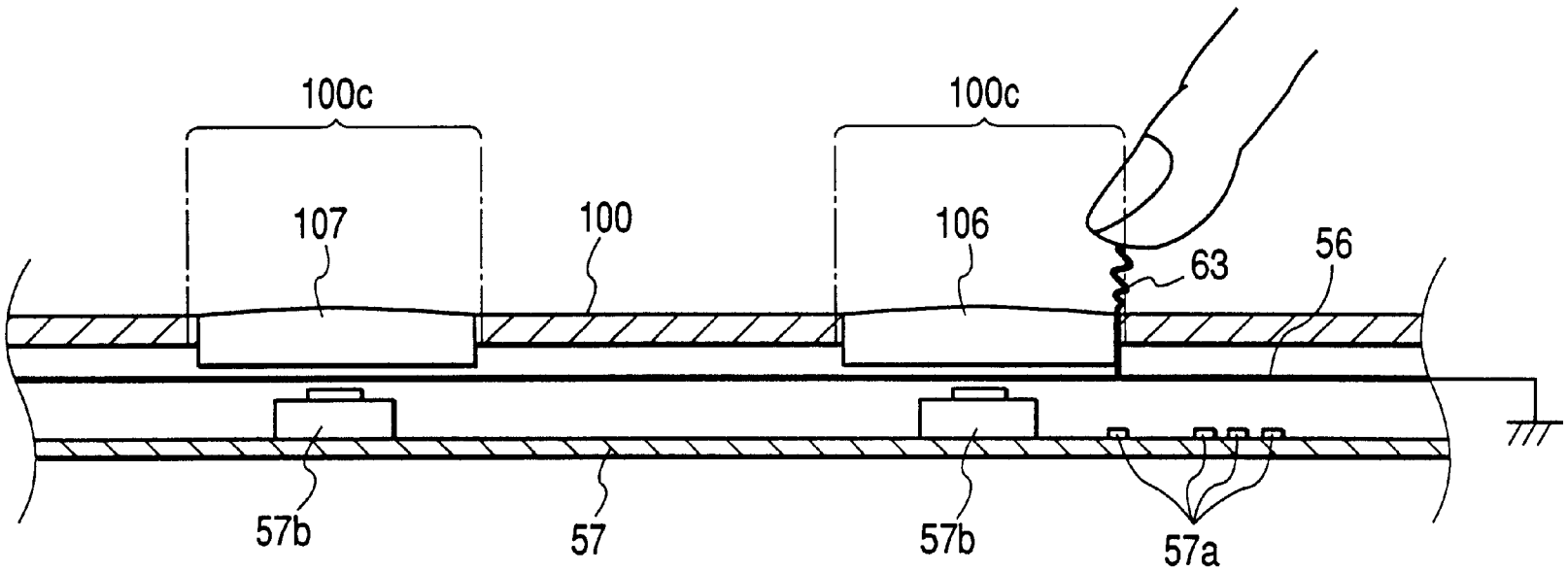
FIG. 10 is a cross-sectional view showing the arranging construction of an upper case, a power source switch, an error releasing switch, a shield plate and a substrate in the recording apparatus in one embodiment of the present invention.

As shown in FIG. 10, the power switch 106 and the error releasing switch 107 are resiliently attached to the recording apparatus so as to project an operation face from a hole portion 100*c* of the upper case 100.

A tact switch 57*b* is located on the substrate 57 through the shield plate 56 just below each of the power switch 106 and the error releasing switch 107. Accordingly, the tact switch 57*b* is arranged on the substrate 57. The tact switch 57*b* corresponding to the power switch 106 and the tact switch 57*b* corresponding to the error releasing switch 107 are pushed through the shield plate 56. Similarly, a tact switch corresponding to a head exchanging switch 108 unillustrated in FIG. 10 is also pushed through the shield plate 56.

The hole 100*c* is formed such that this hole 100*c* is separated from the power switch 106 and the error releasing switch 107 with a clearance of about 0.2 mm and does not interfere with the power switch 106 and the error releasing switch 107 in size.

Therefore, when these switches are operated by a charged user, static electricity is discharged through the clearance between the hole 100*c* of the upper case 100 and the power switch 106 or the error releasing switch 107. Since the shield plate 56 is electrically connected to the ground, the static electricity flows into the ground so that elements of the substrate 57 and a pattern 57*a* are protected.

[Carrier Scanning Section]

Figure 11:
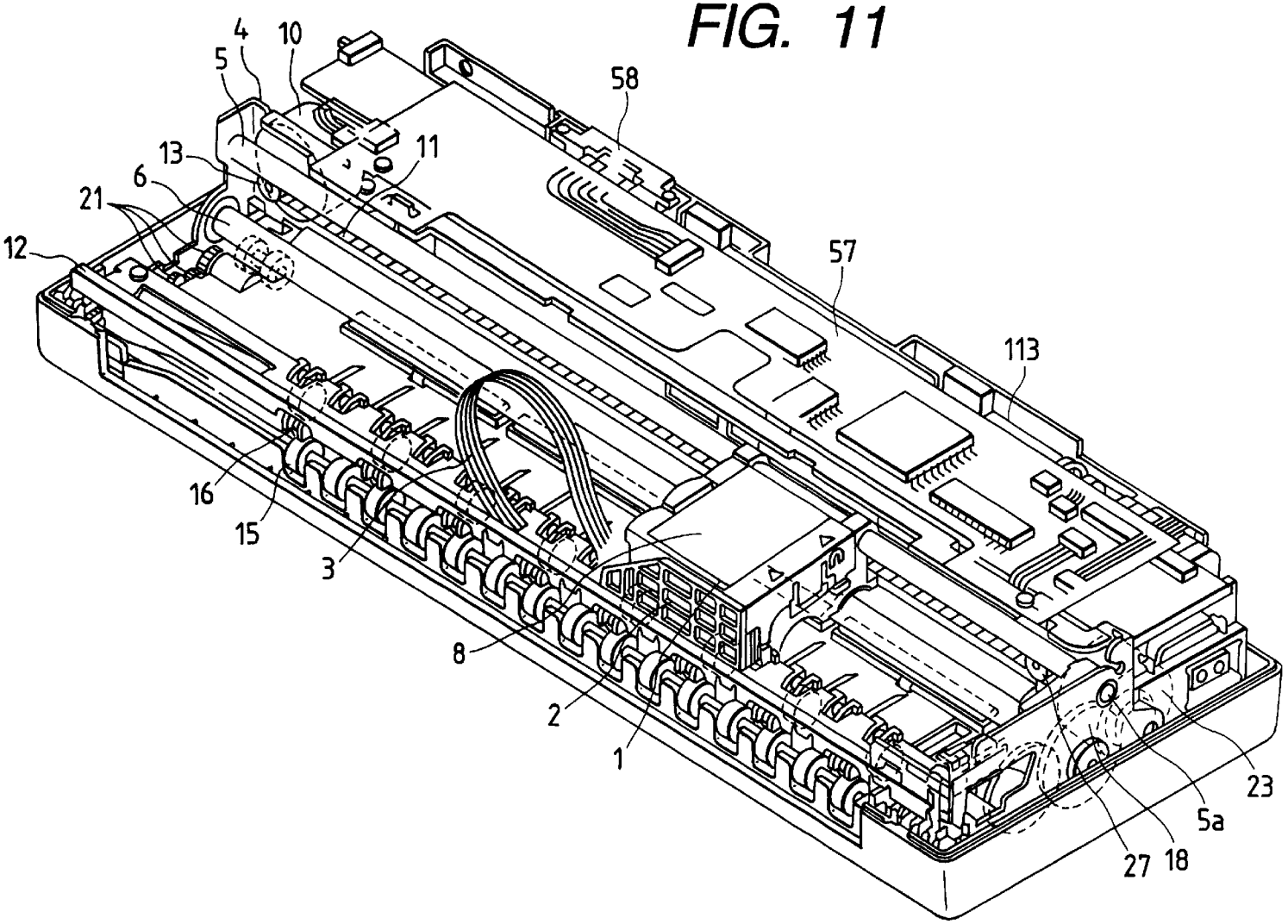
FIG. 11 is an exploded perspective view of the internal construction of the recording apparatus in one embodiment of the present invention seen from its paper discharging side.

FIG. 11 is an exploded perspective view of an internal construction of the recording apparatus in one embodiment of the present invention seen from the paper discharging side.

As shown in FIG. 11, this recording apparatus has a carrier 2 for holding a recording head cartridge 1 such that the recording head cartridge 1 is detachably attached to the recording apparatus. Both end portions of each of a guide shaft 5 and a guide rail 12 arranged in parallel with each other are fixed to the frame 4. A moving direction of the carrier 2 crosses a conveying direction of an unillustrated recording sheet (a recording medium including a recordable flexible sheet such as a plastic sheet, etc.). For example, the moving direction of the carrier 2 is perpendicular to this conveying direction. The carrier 2 is slidably supported by the guide shaft 5 and the guide rail 12 in a main scanning direction along a face of the recording sheet 22.

The guide shaft 5 is constructed by a thin hollow shaft formed in a pipe shape. A plug 5*a* is fixed to one end of this guide shaft 5 and has a groove portion for fixing the guide shaft 5 to the frame 4.

The carrier 2 is connected to one portion of a belt 11 wound between a drive pulley 13 and a drive pulley (an idle pulley) 27. The drive pulley 13 is rotated by a carrier motor 10 fixed to the frame 4. The drive pulley 27 is supported by the frame 4 through an unillustrated spring so as to freely slide and rotate this drive pulley 27 in a direction parallel to the guide shaft 5. The belt 11 is moved by driving the carrier motor 10 so that the carrier 2 is reciprocated in the above direction along the guide shaft 5 and the guide rail 12.

An ink tank 8 is detachably attached to the recording head cartridge 1. When the recording apparatus runs out of ink by a recording operation, the next recording operation can be performed by replacing the ink tank 8 with a new one.

This recording apparatus has an unillustrated home position sensor for detecting a position of the carrier 2 by detecting passage of the carrier 2, and a flexible cable 3 for transmitting an electric signal from the control substrate 57 to the recording head cartridge 1.

[Paper Feed Section]

A construction for conveying the recording sheet 22 will next be explained with reference to FIG. 11.

A paper feed roller 6 is rotatably supported by the frame 4 and an LF gear 18 is fixed to a shaft end of the paper feed roller 6. This paper feed roller 6 is manufactured by a thin hollow shaft formed in a pipe shape in which urethane painting is performed in an outer circumference of this thin hollow shaft to make the paper feed roller 6 light in weight. This pipe shape is set to 7.561 mm in outside diameter $\phi$, 5 mm in inside diameter $\phi$ and pipe thickness t=1.28 mm. This size is determined by balancing a vibrating accuracy in manufacture, tolerance of the outer circumference, lightening, a strength problem of the frame 4 at a dropping time, etc. The paper feed roller 6 is rotated by the paper feed motor 23 through the LF gear 18.

FIG. 12 shows a cross-sectional view of the recording apparat us in one embodiment of the present invention.

As shown in this figure, the lower side of a paper conveying face is mainly constructed by the platen 14. The platen 14 is assembled along an inner wall of the lower case 101. A box structure having a clearance for storing a used ink absorbing body 327 is formed between the platen 14 and the lower case 101. In this state, the platen 14 and the lower case 101 are fastened by vises so that the warp of parts as a single body is corrected and rigidity of the recording apparatus is improved.

Ribs each having a projecting shape for reducing attachment of the recording apparatus sheet 22 caused by static electricity and a sliding load during conveyance of the recording sheet are formed in plural columns on a surface of the platen 14 along a conveying direction of the recording sheet 22.

A pinch roller 7 held by a pinch roller holder 9 rotatably attached to the platen 14 comes in press contact with the paper feed roller 6 by an unillustrated spring from below. The unillustrated recording sheet supported between the paper feed roller 6 and the pinch roller 7 is conveyed by driving the paper feed motor 23 (see FIG. 11).

The diameter of an outer circumferential portion of the pinch roller 7 for supporting the recording sheet 22 between this pinch roller 7 and the paper feed roller 6 is set to an outside diameter $\phi$ of 6 mm slightly smaller than that of the paper feed roller 6. A ratio of the outside diameter of a rotating shaft portion held by the pinch roller holder 9 to the diameter of the outer circumferential portion of the pinch roller 7 is set to 2:15 and this outside diameter of the rotating shaft portion is set to a shaft diameter ϕ of 0.8 mm. Further, a material of the pinch roller 7 is formed by aluminum as a light metal. Therefore, since the pinch roller 7 is light in weight and a rotating load of this pinch roller 7 is small, the recording sheet 22 can be fed without almost causing any conveying loss. Further, since the outside diameters of the pinch roller 7 and the paper feed roller 6 are almost equal to each other, the unillustrated recording sheet is easily introduced to a contact (nip) of the pinch roller 7 and the paper feed roller 6 when the recording sheet is fed. Furthermore, it is possible to reduce force for pushing an end tip of the recording sheet into the nip.

Allogine processing is performed with respect to both the above outer circumferential portion and the above shaft portion of the pinch roller 7 made of aluminum. Corrosion caused by an ink mist discharged from the recording head cartridge 1 and included within an atmosphere within the recording apparatus, and wearing caused by a sliding movement between the pinch roller 7 and the pinch roller holder 9 for a long time are reduced. Therefore, no rotating load of the pinch roller 7 is almost increased even after the pinch roller 7 is used for a long period.

Paper discharging rollers 15 for discharging the recorded recording sheet to the exterior of the recording apparatus are attached in two columns to the platen 14 on a side opposed to the paper feed roller 6 through the recording head cartridge 1. Driving force is transmitted from the paper feed roller 6 to each paper discharging roller 15 through an idle gear series 21 (see FIG. 11) so that the paper discharging roller 15 is rotated in synchronization with the paper feed roller 6. A spur 16 attached to the guide rail 12 is arranged above the paper discharging roller 15, and the paper discharging roller 15 comes in press contact with the spur 16 by an unillustrated spring from below. Accordingly, the recorded recording sheet is supported and conveyed between the paper discharging roller 15 and the spur 16.

The paper sensor 25 is arranged on the side of a paper feed port 121 opposed to the recording head cartridge 1 through the paper feed roller 6. A paper discharging sensor 17 is arranged between the paper discharging rollers 15 in two columns. Each of these sensors detects existence or nonexistence of the recording sheet in the vicinity of each of these sensors.

Figure 13:
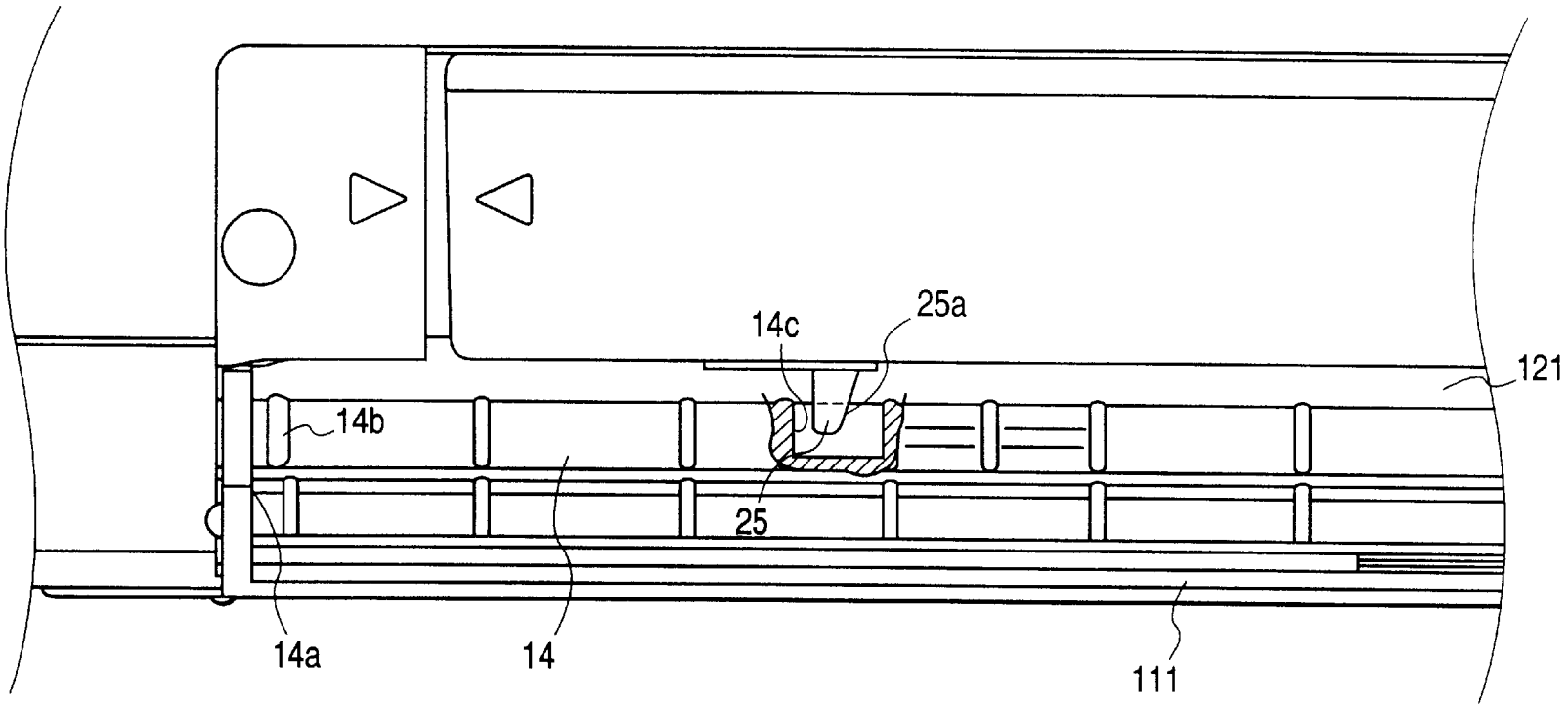
FIG. 13 is a front view showing a paper feed port side of the recording apparatus in one embodiment of the present invention.

FIG. 13 is a front view showing a paper feed port side of the recording apparatus in one embodiment of the present invention.

The platen 14 has a paper guide portion 14*a* as a reference in insertion of the recording sheet at a left-hand end seen from the paper feed port side. Further, plural ribs each having a projecting shape are formed on a surface of the platen 14. A rib 14*b* nearest to the paper guide portion 14*a* among these ribs has a gentle inclination only on a slanting face on a side opposed to the paper guide portion 14*a* to prevent catching of the recording sheet when the recording sheet is moved toward the paper guide portion 14*a*.

Further, the platen 14 has a concave portion 14*c* and an end tip of the paper sensor 25 is stored into this concave portion 14*c* when no recording sheet is inserted into this concave portion.

A taper portion 25*a* is formed on a side of the paper sensor 25 opposed to the paper guide portion 14*a*. Therefore, the recording sheet is inserted into a portion deeper than the paper sensor 25 on a side far from the paper guide portion 14*a*. Thereafter, when the recording sheet is moved toward the paper guide portion 14*a*, damages of the recording sheet and the paper sensor 25 can be prevented.

[Recording Section]

In a function of this recording apparatus, the recording head cartridge 1 discharges ink toward a lower face of the recording apparatus in FIG. 11 in synchronization with a reciprocating movement of the carrier 2 in accordance with a recording signal. Thus, a one-line recording operation of the recording sheet is performed. Namely, this recording head cartridge 1 has a fine liquid discharging port (orifice), a liquid path, an energy acting portion formed in one portion of this liquid path, and an energy generating means for generating droplet forming energy applied to a liquid in this acting portion.

The energy generating means for generating such energy is constructed by a recording method using an electromechanical converting element such as a piezo element, etc., a recording method using an energy generating means for heating a droplet by irradiating an electromagnetic wave such as a laser, etc. to the droplet and discharging the droplet by an action of this heating, or a recording method using an energy generating means for heating a liquid by an electrothermal converting element such as a heating element having a heating resistor, etc. and discharging the liquid, etc.

A recording head used in an ink jet recording method for discharging the liquid by thermal energy among the above recording methods can perform a recording operation of high resolution since liquid discharging ports for discharging the liquid for recording and forming a droplet for discharge can be arranged at high density. The recording head using the electrothermal converting element as an energy generating source is easily made compact. Further, the merits of an IC technique and a micro processing technique greatly progressing and improved in reliability in a recent semiconductor field can be sufficiently applied to this recording head using the electrothermal converting element. Accordingly, it is advantageous to use the recording head using the electrothermal converting element since this recording head is easily mounted to the recording apparatus at high density and manufacturing cost of this recording head is low.

When the one-line recording operation is performed by moving the recording head cartridge 1, the recording sheet is conveyed by one line by the paper feed motor 23 in the direction of an arrow shown as a conveying direction on the recording sheet 22 shown in FIG. 3 and the recording operation is performed on the next line.

[Head Mounting Section]

A head able to be mounted to this recording apparatus will next be explained.

In the above explanation, the recording head cartridge 1 is detachably attached onto the carrier 2 of this recording apparatus as an example. However, there are two kinds of a monochromatic recording head portion and a color recording head portion in detail in the recording head cartridge 1. Further, there is a scanner head capable of reading an original inserted instead of the recording sheet 22. One of these three kinds of head portions in total can be mounted onto the carrier 2 of this recording apparatus.

As explained above, the recording apparatus of the present invention can perform a recording operation to the recording sheet 22 by the recording head cartridge 1 and can also read the original by the scanner head. Accordingly, when it refers to the recording sheet 22 in the present invention, the recording sheet 22 includes the original except for the case of an explanation relating to only the recording operation.

[Circuit Section]

Figure 14:
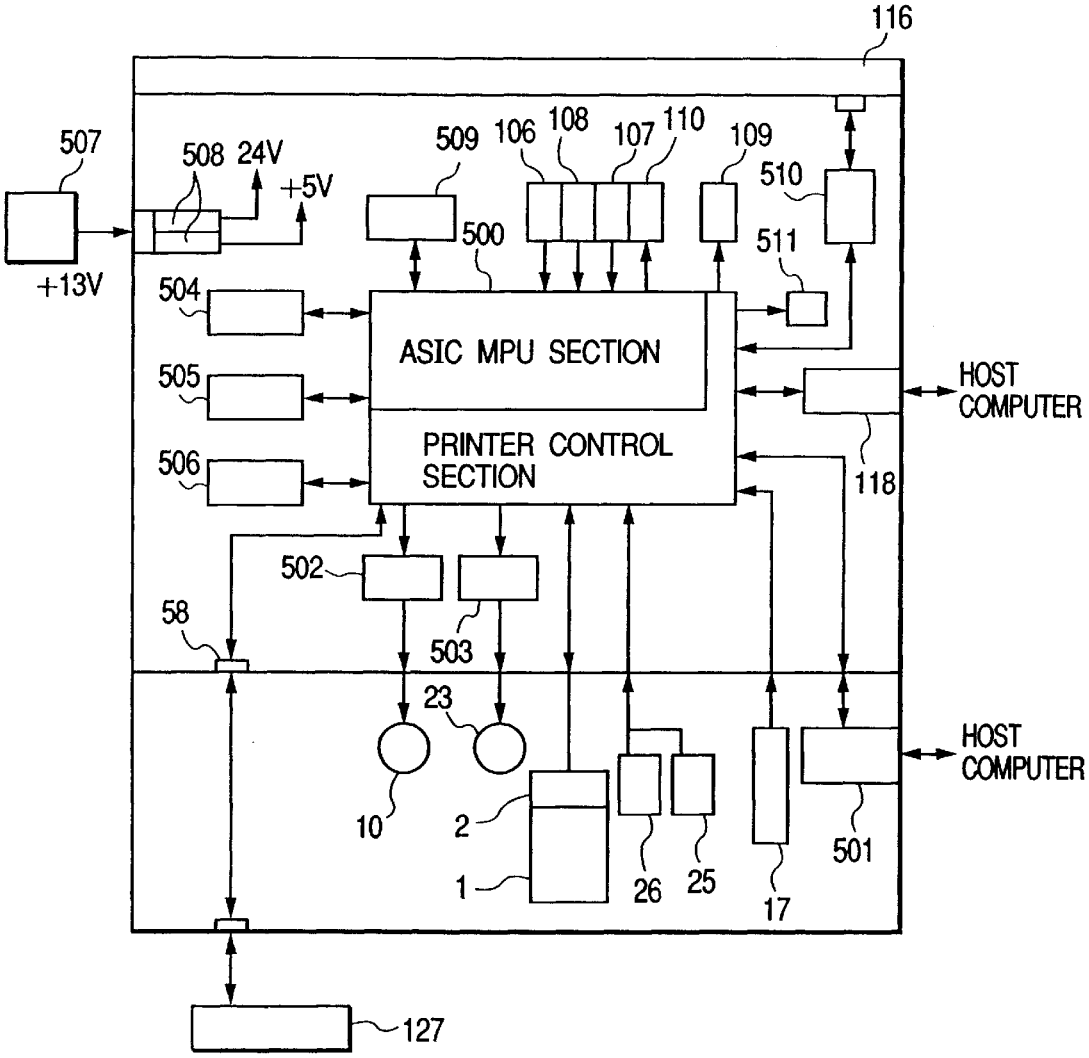
FIG. 14 is a block diagram showing an electric construction of the recording apparatus in one embodiment of the present invention.

FIG. 14 shows a block diagram of an electric construction of this recording apparatus.

In FIG. 14, reference numeral 500 designates an ASIC integrated with an MPU section and a printer control section. Reference numeral 504 designates a flash ROM into which a program for controlling an entire operation of the recording apparatus is stored. Reference numeral 505 designates a mask ROM for storing character fonts, etc. Reference numeral 506 designates a DRAM used as a buffer of a working area and a signal of the ASIC 500. Reference numeral 509 designates an EEPROM constructed by a rewritable ROM such that no stored contents vanish even when no power is supplied to this EEPROM. Therefore, information set by a user at a turning-on time of the power source, a used ink amount, an accumulated discharged ink amount collected within the recording apparatus, etc. are written to this EEPROM 509.

Reference numeral 508 designates a DC-DC converter for converting a voltage from an adapter 507 to a power voltage used within the recording apparatus. The adapter 507 converts an alternating current voltage of 100 V for home use to a direct current voltage of 13 V.

A battery 116 is built in this recording apparatus so as to use this recording apparatus even in the exterior of a house in which there is no power source for home use. Further, a battery charging circuit 510 is built in the recording apparatus so that the battery is charged without separately preparing any charger.

Reference numeral 502 designates a carrier motor driver for moving the carrier 2. Reference numeral 503 designates a paper feed motor driver for operating the paper feed roller 6. The carrier motor driver 502 and the paper feed motor driver 503 control operations of respective motors by a control signal outputted from the AISIC 500.

Reference numeral 106 designates the power switch for turning on the power source of the recording apparatus body. Reference numeral 108 designates a head exchanging switch for moving the carrier 2 to an exchanging position. Reference numerals 107, 110, 109 and 511 respectively designate the error releasing switch, the power lamp, the error lamp and a buzzer.

Reference numerals 118 and 501 respectively designate an interface connector and an infrared module. For example, signal communication with the exterior of the recording apparatus such as a host computer, etc. is performed by the interface connector 118 and the infrared module 501. The interface connector 118 is connected to the host computer by wire. The infrared module 501 is a serial communication port using an infrared ray and is opposed to an infrared port of the host computer and inputs and outputs a signal provided by the infrared ray.

The option connector 58 is prepared for communication with an option ASF 127.

An HP sensor 26 detects a position of the carrier 2 by detecting an edge portion of the carrier 2 in a sensor of a photo interrupter type. Each of the paper sensor 25 and the paper discharging sensor 17 is a sensor of a contact type and detects existence or nonexistence of a recording sheet within the recording apparatus.

In the above-explained embodiments, a recording apparatus has a battery as a driving power source of the recording apparatus; a holding portion for holding the battery; connecting means for electrically connecting the recording apparatus and the battery to each other; biasing means for biasing the battery on a side opposed to a mounting direction of the battery when the battery is held in the holding portion; and fixing means for fixing the battery held in the holding portion against the biasing force of the biasing means. Accordingly, when a fixing state of the battery is released by the fixing means, the battery is pushed out of the holding portion by the biasing force of the biasing means. Therefore, it is possible to simply exchange the battery at a carrying destination by a one touch operation.

Further, since the battery is held in an upper portion of the paper feed port of the recording apparatus, it is not necessary to perform a complicated operation in which the recording apparatus is turned upside down and a cover is detached from the recording apparatus, etc.

What is claimed is:

1. A recording apparatus comprising:

a holding portion for holding a battery, the battery having a stepped portion formed at one end and serving as a power source;

a concave portion, for receiving the stepped portion, formed in said holding portion;

a connecting member for electrically connecting said recording apparatus to the battery when the battery is held in said holding portion;

a biasing member for biasing the battery on a side opposed to a mounting direction of the battery when the battery is held in said holding portion; and a fixing member for fixing the battery held in said holding portion against the biasing force of said biasing member.

2. The recording apparatus according to claim 1, further comprising conveying means for conveying a recorded recording medium and a paper feed port for feeding the recording medium to said conveying means, wherein the battery can be arranged in an upper portion of said paper feed port.

3. The recording apparatus according to claim 1 or 2, wherein a box body of the battery forms one portion of an insertion guide face to guide the recording medium into the recording apparatus.

4. The recording apparatus according to claim 1, wherein the battery can be projected and detached from said holding portion by said biasing member at a releasing time of said fixing member while the battery is rotated from a side opposed to said concave portion of said holding portion with said connecting member as a center.

5. The recording apparatus according to claim 1, wherein the battery can be fixed to said holding portion by inserting the stepped portion of the battery into said concave portion of said holding portion, and rotating the battery on a side opposed to said concave portion of said holding portion with said connecting member as a center, and fixing the battery by said fixing means against the biasing force of said biasing member.

6. The recording apparatus according to claim 1, further comprising a rail approximately parallel to a conveying direction of a recording medium arranged in said holding portion at a position opposed to said concave portion, and a groove portion engagable with said rail is formed in an end portion of the battery opposite to the stepped portion.

7. The recording apparatus according to claim 1, wherein said fixing member includes a hook biased so as to project to a position opposed to said concave portion of said holding portion, and a lever for retreating said hook, with a concave area formed in an end portion of the battery opposite to the stepped portion capable of receiving said hook.

8. The recording apparatus according to claim 1, wherein said connecting member is constructed by connecting terminals respectively arranged in said concave portion of said holding portion and the stepped portion of the battery.

9. The recording apparatus according to claim 1, wherein said biasing member is arranged in a position near a portion opposed to said concave portion of said holding portion on a deep side of said holding portion on which the battery is held.

10. The recording apparatus according to claim 1, further comprising an ink jet recording head for discharging ink from an ink discharging port in a recording operation.

11. A battery holding mechanism comprising:

a battery as a driving power source of a device, said battery including a stepped portion at one end;

a holding portion for holding said battery, said holding portion including a concave portion for receiving said stepped portion;

a connecting member for electrically connecting the device and said battery to each other when said battery is held in said holding portion;

a biasing portion for biasing said battery on a side opposed to a mounting direction of said battery when said battery is held in said holding portion; and fixing means for fixing said battery held in said holding portion against a biasing force of said biasing member.

12. The battery holding mechanism according to claim 11, further comprising a rail approximately parallel to a desirable direction arranged in a position opposed to said concave portion of said holding portion, and a groove portion engaged with said rail is formed in an end portion of said battery opposite to said stepped portion.

13. The battery holding mechanism according to claim 11 or 12, wherein said fixing member is constructed by a hook biased so as to project to a position opposed to said concave portion of said holding portion, and a lever for retreating said hook, with a concave surface formed in an end portion of said battery opposite to said stepped portion and fitted to said hook.

14. The battery holding mechanism according to claim 11, wherein said connecting member is constructed by connecting terminals respectively arranged in said concave portion of said holding portion and said stepped portion of said battery.

15. The battery holding mechanism according to claim 11, wherein said biasing member is arranged in a position near a portion opposed to said concave portion of said holding portion on a deep side of said holding portion on which said battery is held.

16. A recording apparatus comprising:

a holding portion for holding a power unit, the power unit having a stepped portion formed at one end and serving as a driving power source;

a concave portion, for receiving the stepped portion, formed in said holding portion;

a connecting member for electrically connecting the recording apparatus to the power unit when the power unit is held in said holding portion;

a biasing member for biasing the power unit on a side opposed to a mounting direction of the power unit when the power unit is held in said holding portion; and a fixing member for fixing the power unit held in said holding portion against a biasing force of said biasing member.

17. The recording apparatus according to claim 16, further comprising conveying means for conveying a recorded recording medium and a paper feed port for feeding the recording medium to said conveying means, wherein the battery can be arranged in an upper portion of said paper feed port.

18. The recording apparatus according to claim 16, wherein a box body of the battery forms one portion of an insertion guide face to guide the recording medium into the recording apparatus.

19. The recording apparatus according to claim 16, further comprising a rail approximately parallel to a conveying direction of a recording medium arranged in said holding portion at a position opposed to said concave portion, and a groove portion engagable with said rail is formed in an end portion of the battery opposite to the stepped portion.

20. The recording apparatus according to claim 16, wherein said fixing means includes a hook biased so as to project to a position opposed to said concave portion of said holding portion, and a lever for retreating said hook, with a concave area formed in an end portion of the battery opposed to the stepped portion capable of receiving said hook.

21. The recording apparatus according to claim 16, further comprising an ink jet recording head for discharging ink from an ink discharging port in a recording operation.

22. A power unit holding mechanism comprising:

a power unit as a driving power source of a device, said power unit including a stepped portion at one end;

a holding portion for holding said power unit, said holding portion including a concave portion for receiving said stepped portion;

a connecting member for electrically connecting the device to said power unit when said power unit is held in said holding portion;

a biasing member for biasing said power unit at a side opposed to a mounting direction of said power unit when said power unit is held in said holding portion; and a fixing member for fixing said power unit held in said holding portion against a biasing force of said biasing member.

23. The recording apparatus according to claim 22, further comprising conveying means for conveying a recorded recording medium and a paper feed port for feeding the recording medium to said conveying means, wherein said power unit can be arranged in an upper portion of said paper feed port.

24. The recording apparatus according to claim 22, wherein a box body of said power unit forms one portion of an insertion guide face to guide the recording medium into the recording apparatus.

25. The recording apparatus according to claim 22, further comprising a rail approximately parallel to a conveying direction of a recording medium arranged in said holding portion at a position opposed to said concave portion, and a groove portion engagable with said rail is formed in an end portion of said power unit opposite to said stepped portion.

26. The recording apparatus according to claim 22, wherein said fixing means includes a hook biased so as to project to a position opposed to said concave portion of said holding portion, and a lever for retreating said hook, with a concave area formed in an end portion of said power unit opposed to said stepped portion capable of receiving said hook.

27. The recording apparatus according to claim 22, further comprising an ink jet recording head for discharging ink from an ink discharging port in a recording operation.

28. A recording apparatus comprising:

a holding portion for holding a battery, the battery having a stepped portion at one end and serving as a driving power source of a device;

a concave portion, for receiving the stepped portion, formed in said holding portion;

a connecting member for electrically connecting the device and said battery to each other when said battery is held in said holding portion;

a biasing member for biasing the battery on a side opposed to a mounting direction of the battery when the battery is held in said holding portion;

a fixing member for fixing the battery held in said holding portion against a biasing force of said biasing member; and a paper feed port for feeding a recording medium, wherein said holding portion is arranged in an upper portion of said paper feed port and includes an insertion guide face to guide the recording medium into the recording apparatus.

29. The recording apparatus according to claim 28, further comprising conveying means for conveying a recorded recording medium, wherein said paper feed port feeds the recording medium to said conveying means.

30. The recording apparatus according to claim 28, wherein a box body of the battery forms one portion of an insertion guide face to guide the recording medium into the recording apparatus.

31. The recording apparatus according to claim 28, further comprising a rail approximately parallel to a conveying direction of a recording medium arranged in said holding portion at a position opposed to said concave portion, and a groove portion engagable with said rail is formed in an end portion of the battery opposite to the stepped portion.

32. The recording apparatus according to claim 28, wherein said fixing means includes a hook biased so as to project to a position opposed to said concave portion of said holding portion, and a lever for retreating said hook, with a concave area formed in an end portion of the battery opposed to the stepped portion capable of receiving said hook.

33. The recording apparatus according to claim 28, further comprising an ink jet recording head for discharging ink from an ink discharging port in a recording operation.

* * * * *

UNITED STATES PATENT AND TRADEMARK OFFICE

CERTIFICATE OF CORRECTION

PATENT NO. : 6,382,761 B1
DATED : May 7, 2002
INVENTOR(S) : Shinya Asano et al.

It is certified that error appears in the above-identified patent and that said Letters Patent is hereby corrected as shown below:

Column 3,
Line 24, "on e" should read -- one --.
Line 29, "a n" should read -- an --.
Line 31, "deposit" should read -- deposit- --.

Column 8,
Line 40, "apparat us" should read -- apparatus --.

Signed and Sealed this

Third Day of September, 2002

*Attest:*

*Attesting Officer*

JAMES E. ROGAN
*Director of the United States Patent and Trademark Office*